US008770263B2

(12) United States Patent
Hanna et al.

(10) Patent No.: US 8,770,263 B2
(45) **Date of Patent: *Jul. 8, 2014**

(54) METHOD OF CASTING DAMPED PART WITH INSERT

(75) Inventors: Michael D. Hanna, West Bloomfield, MI (US); Mohan Sundar, Troy, MI (US); Andrew Schertzer, St. Catharines (CA)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/113,619

(22) Filed: May 23, 2011

(65) Prior Publication Data

US 2011/0220313 A1 Sep. 15, 2011

Related U.S. Application Data

(63) Continuation of application No. 12/174,223, filed on Jul. 16, 2008, now Pat. No. 7,950,441.

(60) Provisional application No. 60/950,906, filed on Jul. 20, 2007.

(51) Int. Cl.
*B22D 19/00* (2006.01)

(52) U.S. Cl.
USPC ..... 164/98; 164/112

(58) Field of Classification Search
USPC ..... 164/98–112
See application file for complete search history.

(56) References Cited

U.S. PATENT DOCUMENTS

| | | | | |
|---|---|---|---|---|
| 3,191,252 | A * | 6/1965 | Webbere | 164/75 |
| 4,997,024 | A * | 3/1991 | Cole et al. | 164/75 |
| 5,263,533 | A * | 11/1993 | Druschitz et al. | 164/363 |
| 6,257,310 | B1 * | 7/2001 | Janko | 164/61 |
| 6,758,532 | B2 * | 7/2004 | Rhee | 301/37.43 |
| 6,860,315 | B2 * | 3/2005 | Williamson | 164/133 |
| 7,013,947 | B1 * | 3/2006 | Stahl et al. | 164/103 |
| 7,644,750 | B2 * | 1/2010 | Schroth et al. | 164/100 |
| 7,775,332 | B2 * | 8/2010 | Hanna et al. | 188/218 XL |
| 7,937,819 | B2 * | 5/2011 | Hanna et al. | 29/458 |
| 8,245,758 | B2 * | 8/2012 | Hanna et al. | 164/98 |
| 2004/0020626 | A1 * | 2/2004 | Ban et al. | 164/56.1 |
| 2007/0062768 | A1 | 3/2007 | Hanna et al. | |
| 2007/0213868 | A1 * | 9/2007 | MacDonald et al. | 700/197 |
| 2007/0284073 | A1 * | 12/2007 | Vogt et al. | 164/100 |

FOREIGN PATENT DOCUMENTS

| | | |
|---|---|---|
| CN | 2863313 Y | 1/2007 |

* cited by examiner

*Primary Examiner* — Kevin P Kerns
*Assistant Examiner* — Steven Ha
(74) *Attorney, Agent, or Firm* — BrooksGroup

(57) ABSTRACT

A method including positioning an insert in a vertical mold including a first mold portion and a second mold portion; and casting a material including a metal around at least a portion of the insert.

20 Claims, 9 Drawing Sheets

METHOD OF CASTING DAMPED PART WITH INSERT

CROSS REFERENCE TO RELATED APPLICATIONS

This application is a continuation of U.S. application Ser. No. 12/174,223 filed Jul. 16, 2008, which claims the benefit of U.S. Provisional Application Ser. No. 60/950,906, filed Jul. 20, 2007.

TECHNICAL FIELD

The field to which the disclosure generally relates includes a part with an insert providing frictional damping and method of manufacturing thereof.

BACKGROUND

Parts subjected to vibration may produce unwanted or undesirable vibrations. Similarly, a part or component may be set into motion at an undesirable frequency and/or amplitude and for a prolonged period. For example, parts such as brake rotors, brackets, pulleys, brake drums, transmission housings, gears, and other parts may contribute to noise that gets transmitted to the passenger compartment of a vehicle. In an effort to reduce the generation of this noise and thereby its transmission into the passenger compartment, a variety of techniques have been employed, including the use of polymer coatings on engine parts, sound absorbing barriers, and laminated panels having viscoelastic layers. The undesirable vibrations in parts or components may occur in a variety of other products including, but not limited to, sporting equipment, household appliances, manufacturing equipment such as lathes, milling/grinding/drilling machines, earth moving equipment, other nonautomotive components, and components that are subject to dynamic loads and vibration. These components can be manufactured through a variety of means including casting, machining, forging, die-casting, etc.

SUMMARY OF EXEMPLARY EMBODIMENTS OF THE INVENTION

One embodiment of the invention provides a method including positioning an insert in a vertical mold including a first mold portion and a second mold portion; and casting a material including a metal around at least a portion of the insert.

Other exemplary embodiments of the invention will become apparent from the detailed description provided hereinafter. It should be understood that the detailed description and specific examples, while disclosing exemplary embodiments of the invention, are intended for purposes of illustration only and are not intended to limit the scope of the invention.

BRIEF DESCRIPTION OF THE DRAWINGS

Exemplary embodiments of the present invention will become more fully understood from the detailed description and the accompanying drawings, wherein.

DETAILED DESCRIPTION OF EXEMPLARY EMBODIMENTS

Figure 1:
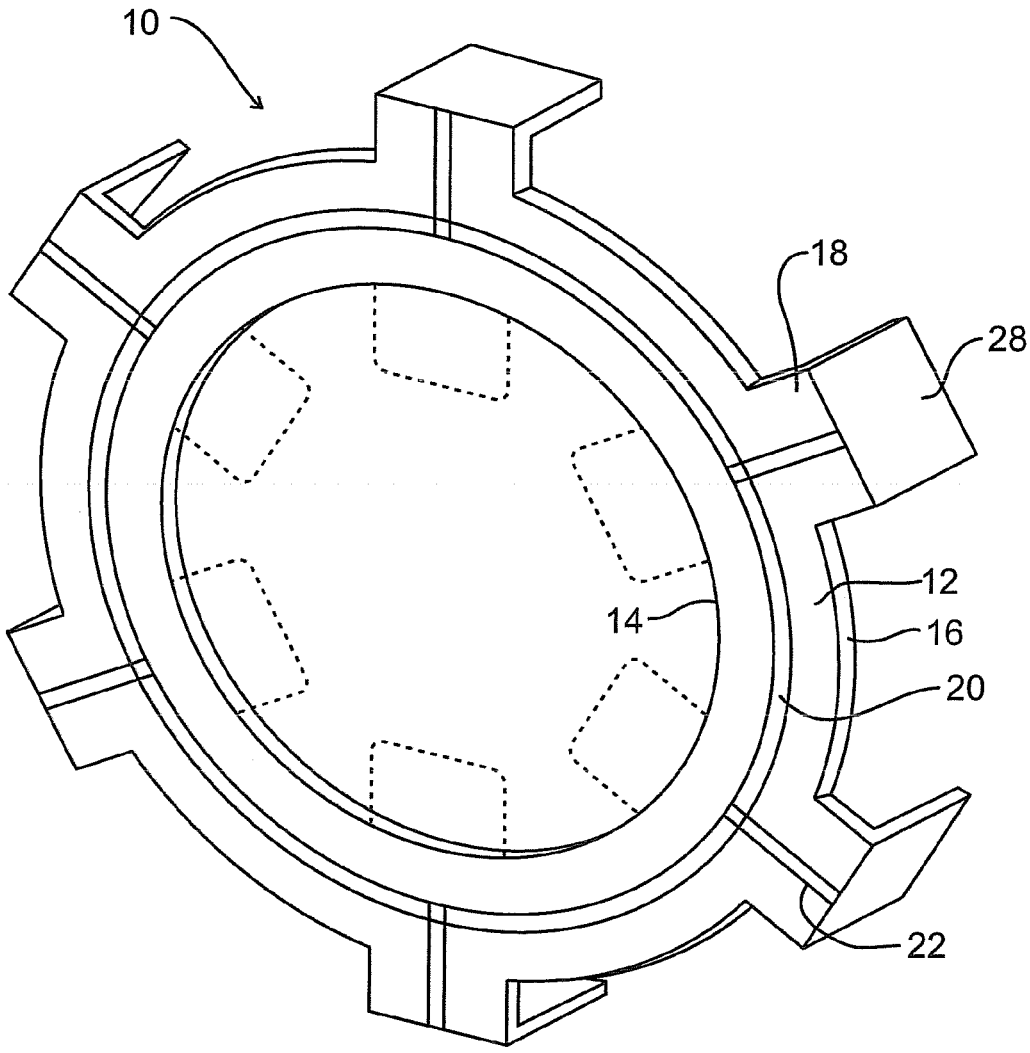
FIG. 1 illustrates a product according to one embodiment of the invention.

The following description of the embodiment(s) is merely exemplary in nature and is in no way intended to limit the invention, its application, or uses.

In one embodiment, a method is provided for manufacturing a part or product 500 with an insert 10 for damping, for example noise damping or simply vibration damping. The part 500 into which the insert 10 is incorporated may comprise any part 500 that could benefit from damping, for example, but not limited to, one of a brake rotor, bracket, pulley, brake drum, transmission housing, gear, motor housing, shaft, bearing, engine, baseball bat, lathe machine, milling machine, drilling machine, or grinding machine. In one embodiment, the method includes a vertical casting process. In the vertical casting embodiment, the insert 10 may rest on and be supported by a mold along a side edge of the insert 10. In another embodiment, the method includes a horizontal casting process. In various other embodiments, the method includes a casting process performed at any suitable angle.

In one embodiment, the vertical casting process includes designing an insert 10 for a particular part 500. The insert 10 may take any shape. In one embodiment shown in FIG. 1, the insert comprises an annular portion 12 having an inner edge 14 and an outer edge 16. Many different characteristics are taken into consideration when designing the insert 10. The material chosen for the insert 10 may depend to some extent on the material selected for the part 500. Other considerations in the design of the insert 10 may be the thickness or the width of the insert 10, as will be described in greater detail hereafter. In various embodiments, the outer diameter of the insert 10 at the outer edge 16 may be smaller than the outer diameter of the part 500 for which the insert 10 is designed. For example, the outer diameter of the insert 10 at the outer edge 16 may be about 5 mm to about 25 mm smaller than the outer diameter of the part 500.

In one embodiment, the insert 10 may include at least one tab 18. Such a tab 18 may extend from at least one of the inner edge 14 or the outer edge 16 of the annular body 12. The thickness of the tab 18 may be such that a first mold portion 11 (shown in FIGS. 4-5) and a second mold portion 13 (not shown) clamp down (crush) the tab 18 when the first mold portion 11 and the second mold portion 13 close to form a mold 15 (shown in FIGS. 4-5). In the embodiment shown in FIG. 1, the tabs 18 extending from the inner edge 14 of the annular body 12 are shown in phantom. In one embodiment, the insert 10 may include twelve tabs. In one embodiment, the insert 10 may include an annular stiffening rib 20. The annular stiffening rib 20 may be approximately equidistant from the inner edge 14 and the outer edge 16 of the annular body 12. In another embodiment, the insert 10 may include a plurality of radial stiffening ribs 22, which extend from the annular stiffening rib 20 of the annular body 12 to an outer edge 16 of the tabs 18.

One embodiment of the invention may include a process including blank stamping of the insert 10. In one embodiment, the insert 10 includes the at least one tab 18 and a portion of the tabs 18 are then bent to form a bent tab portion 28, as shown in FIG. 1. The bent tab portion 28 may be bent ninety degrees relative to the remainder of the tab 18 to at least assist in holding the insert 10 in the mold 15 vertically. Or the bent tab portion 28 may be at any suitable angle relative to the remainder of the tab 18. In one embodiment, the length of the bent tab portion 28 may be about 5 mm.

In one embodiment the insert 10 includes a non-wettable surface that prevents molten metal from bonding to the insert 10 surface. In one embodiment the non-wettable surface may be provided by a layer 520 of particles 514, flakes, or fibers, as will be described in greater detail hereafter. In one embodiment, the layer 520 may be a coating including a binder and the particles 514, flakes, or fibers over the insert 10, or at least a portion of the insert 10 may be otherwise treated so that molten metal does not wet that portion of the insert 10 and bond thereto upon solidification of the molten metal.

One embodiment of the invention may include pre-treating the insert 10 prior to forming the coating over the insert. The pre-treating of the insert 10 may comprise at least one of sand blasting, grit blasting, glass bead blasting, chemical washing, or water jet degreasing. The pre-treating of the insert 10 may result in an abrasive surface on the insert 10. In one embodiment, the pre-treating may also include a chemical cleaning to remove oxides and other surface oils prior to the coating application. In one embodiment, the insert 10 may then be pre-heated prior to coating the insert 10. The insert 10 may be pre-heated to a temperature of about 50° C. to about 250° C. In one embodiment the insert 10 may be pre-heated to a temperature of about 75° C. For example, the insert 10 may travel through an oven to heat the insert 10. Pre-heating the insert 10 may promote the subsequent adhesion of the coating to the insert during the coating process.

Figure 15:
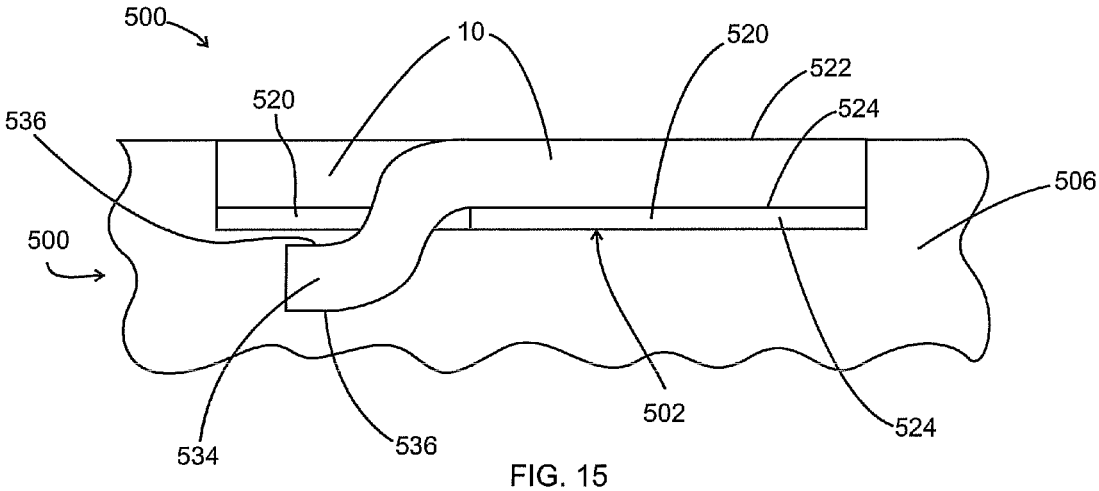
FIG. 15 is a sectional view with portions broken away of one embodiment of the invention.
Figure 16:
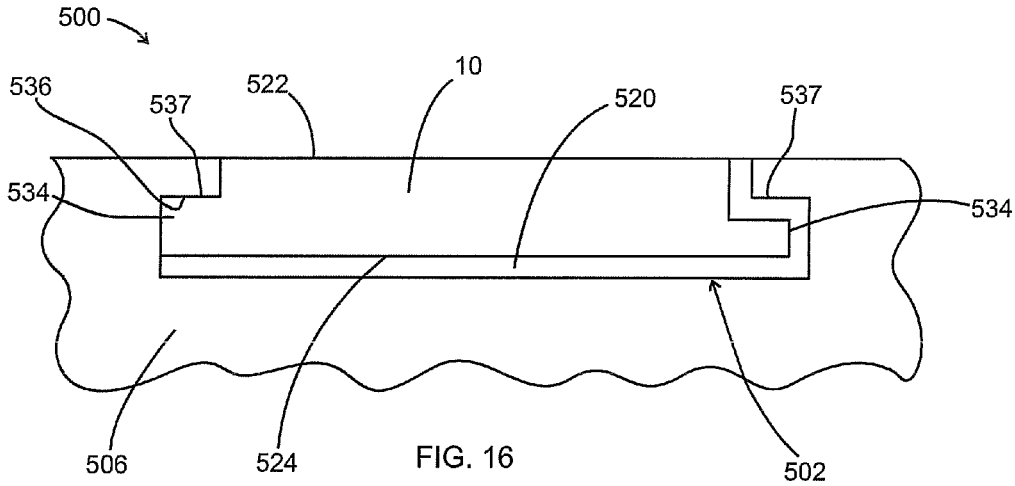
FIG. 16 is a sectional view with portions broken away of one embodiment of the invention.

In one embodiment, the insert 10 may include a coating 520 (as shown in FIGS. 15-16) over the entire insert 10 or only a portion thereof. In another embodiment, the annular body 12 of the insert 10 may be coated, but the tabs 18 may not be coated so that cast metal bonds to the tabs 18. The insert 10 may be coated by any suitable method of coating, for example spraying or dipping. The coating may be capable of withstanding high temperatures used in the casting process. The coating may be sufficiently adherent to the insert 10 such that the coating does not flake or rub off during transportation or handling of the insert, or during the casting process.

In one embodiment, the insert 10 with the coating 520 is then baked. In various embodiments, the bake time and temperature may vary depending on the type of coating 520. For example, in one embodiment the insert may be baked and cured for 20 minutes at a temperature of 140° C. In another embodiment, the insert may be baked for at least two hours at 350° C. Then the insert may be packaged for transportation to the molding line. The packaging may include any suitable packaging to protect the insert 10 so that the coating is not damaged.

Figure 2A:
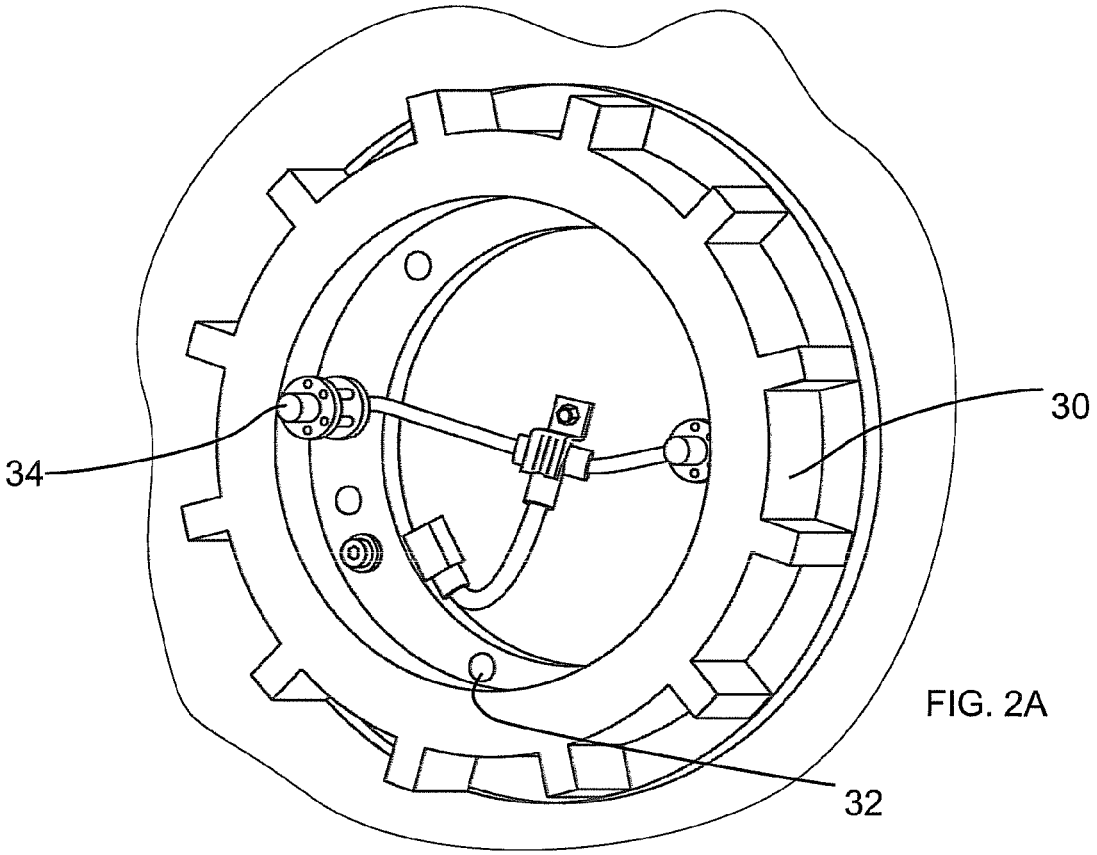
FIG. 2A illustrates a process according to one embodiment of the invention.
Figure 2B:
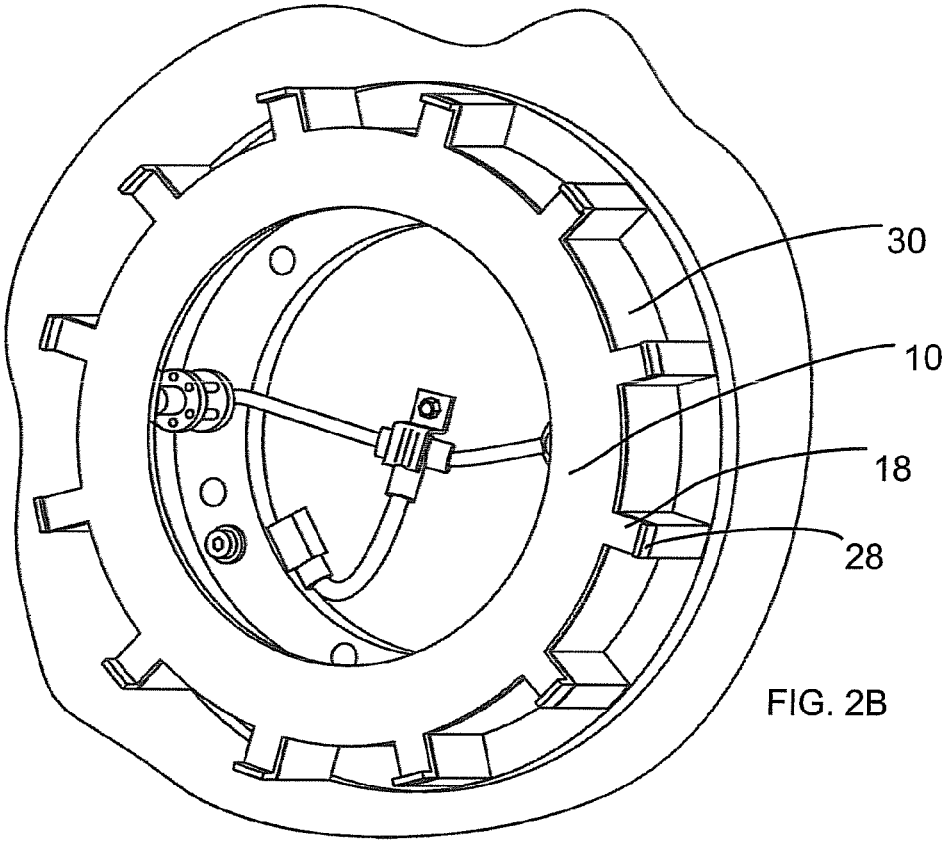
FIG. 2B illustrates a process according to one embodiment of the invention.

Referring to FIGS. 2A-2B, in one embodiment, the insert 10 may be pre-heated before being placed into a setting fixture 30. In one embodiment, the insert 10 may be pre-heated to about 50° C. to about 80° C. For example, the insert 10 may travel through an oven to heat the insert 10. This pre-heating step may remove any moisture on the insert 10 before the insert 10 is loaded in the setting fixture 30. The insert 10 may then be placed into the setting fixture 30. In one embodiment, the setting fixture 30 may be centered and clocked in as accurately as possible. In one embodiment, the cavity in the setting fixture 30 which holds the tabs 18 may be slightly wider than the actual width of the tab 18. For example, the cavity may be 0.50 mm wider on each side of the tab 18, and the setting fixture 30 may be centered to within 0.26 mm of the Total Indicator Reading (TIR) of the tab print width. The setting fixture 30 may include a vacuum 32 to partially assist in loading the insert 10 into the setting fixture 30. The setting fixture 30 may include ejector pins 34 to partially assist in loading the insert 10 into the mold 15.

Figure 3:
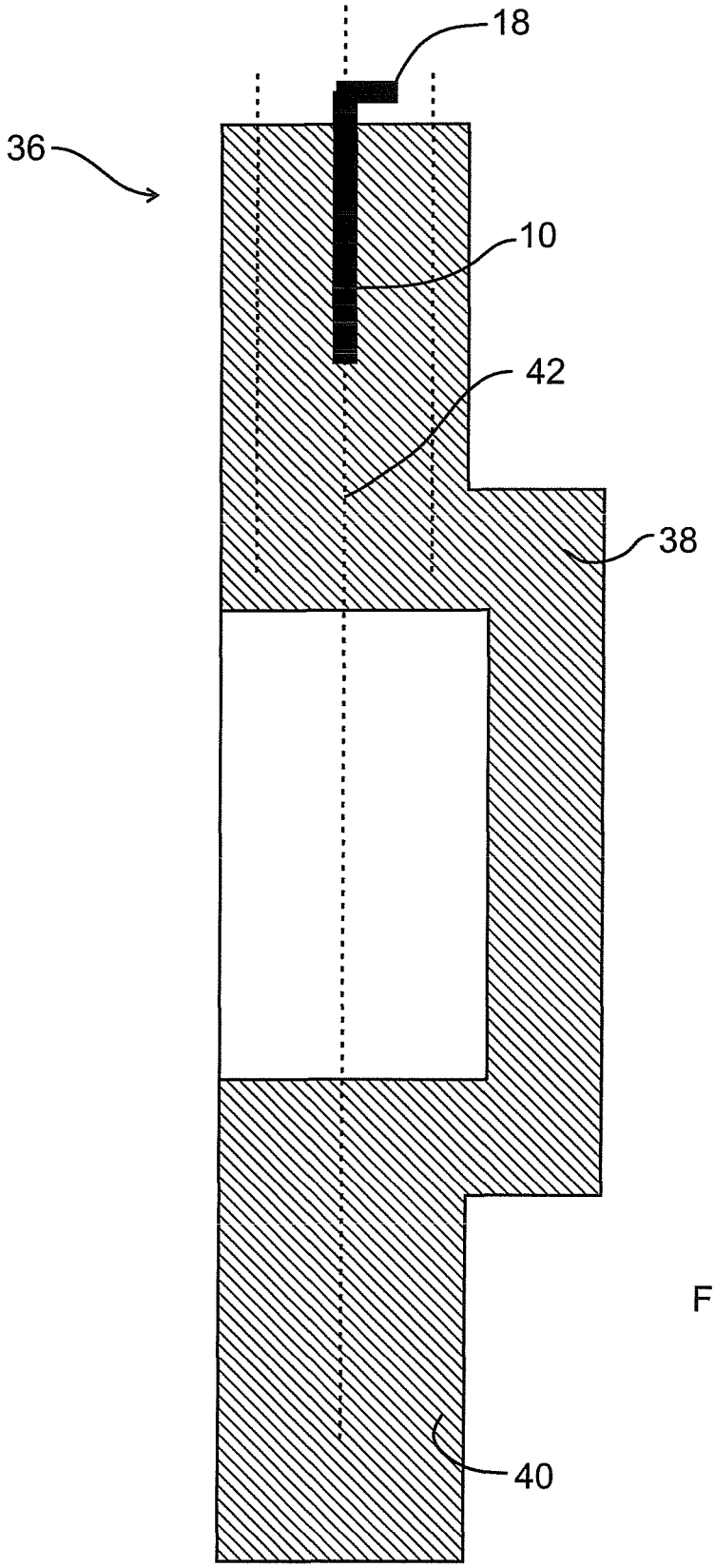
FIG. 3 illustrates a process according to one embodiment of the invention.

In one embodiment, the setting fixture 30 is then used to load the insert 10 into one portion of the mold 15. The ejector pins 34 may be required to push the insert 10 free when the insert is set in the sand mold 15. In one embodiment, a relief of 3.0 mm on the outside of the tab may be required to accommodate the expansion of the insert material, for example steel, during casting. The bent tab portion 28 allows the insert 10 to be attached to the first mold portion 11, for example, so that the bent tab portion 28 engages a lip of the first mold portion 11 so that the insert 10 hangs, is supported, or is attached to the first mold portion 11 prior to closing the mold 15. Referring to FIG. 3, in one embodiment the part 500 being manufactured may be a rotor assembly 36. The rotor assembly 36 may include a hub portion 38 and an annular rotor portion 40. The insert 10 and the tabs 18 may be split equally at a parting line 42 in the mold 15 to ensure that the insert 10 is in the center of the annular rotor portion 40 of the rotor. To accomplish holding of the insert 10 in the mold 15, the tab 18 print, which protrudes into the sand may have a crush of about 0.12 mm to about 0.25 mm built into the print.

Figure 4:
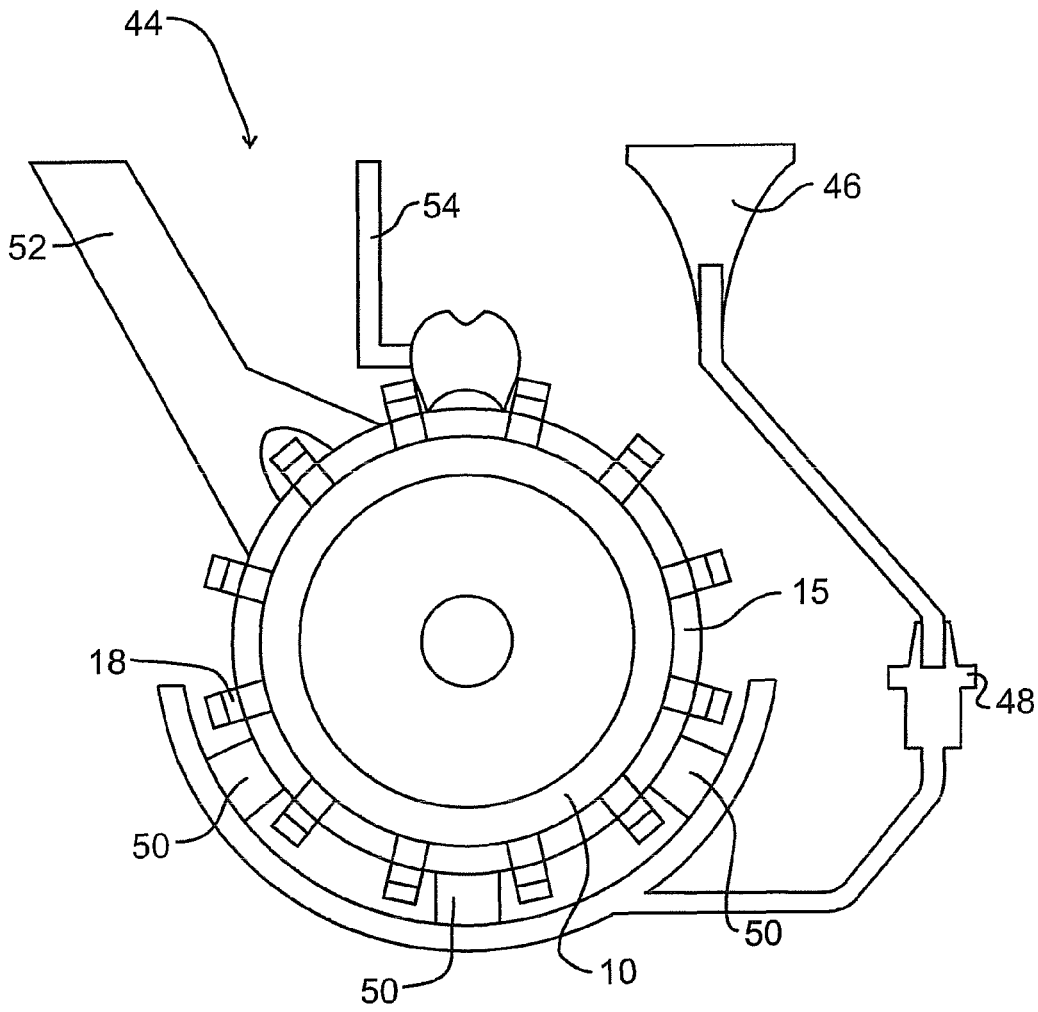
FIG. 4 illustrates a process according to one embodiment of the invention.
Figure 5:
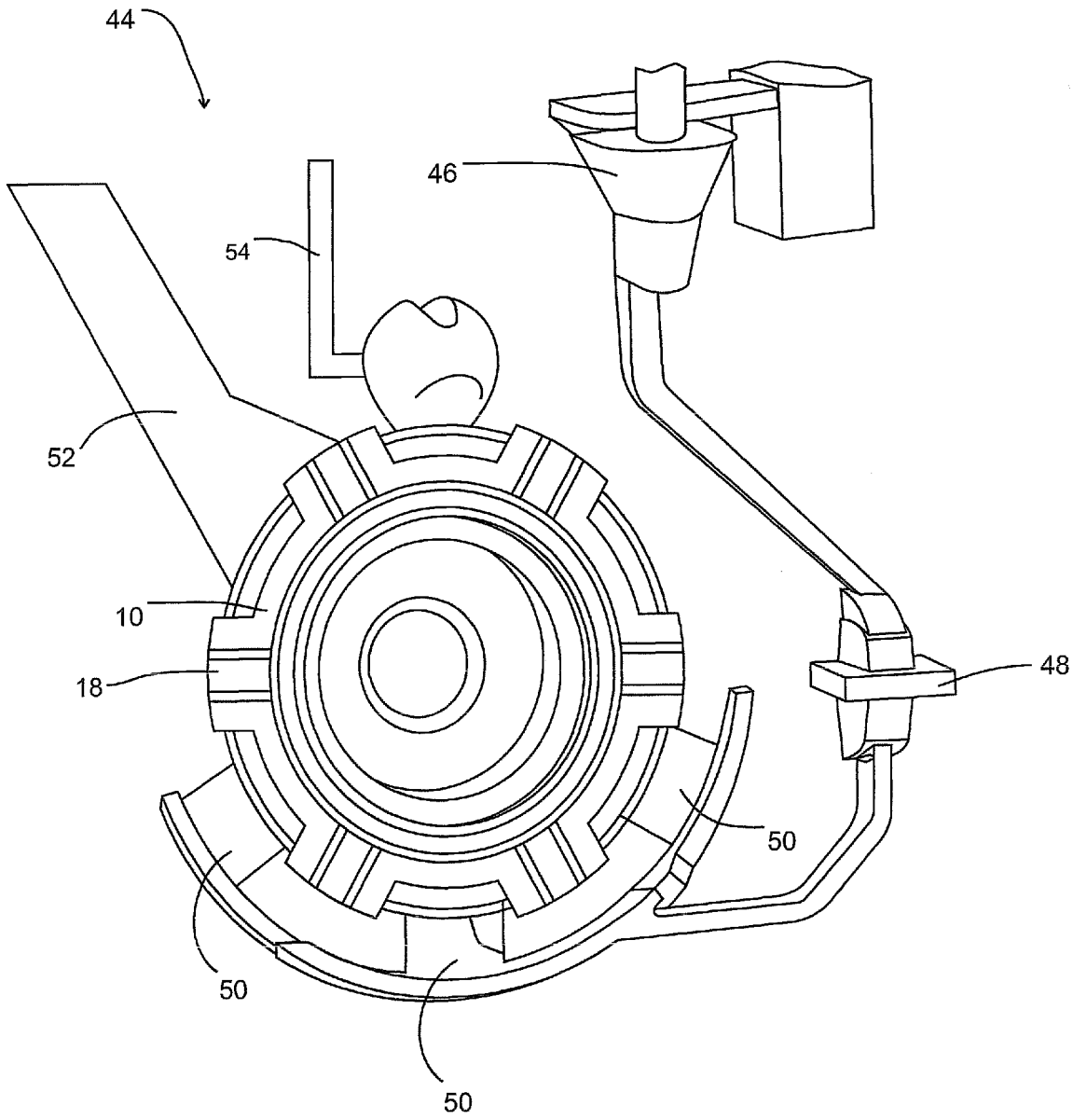
FIG. 5 illustrates a process according to one embodiment of the invention.
Figure 6:
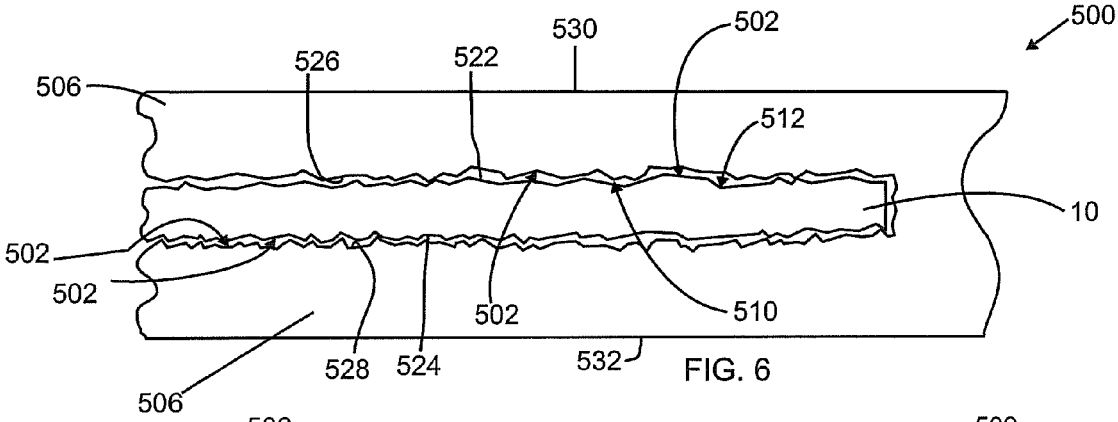
FIG. 6 is a sectional view with portions broken away of one embodiment of the invention including an insert.

After the insert 10 is set in the first mold portion 11 of the mold 15, the first mold portion 11 and the second mold portion 13 (not shown) of the mold 15 may be closed together. Then the mold 15 containing the insert 10 may be moved to a pouring station. The pour rate of material into the mold 15 and the amount of inoculants may then be set. Then the material may be poured into the mold to form the part 500. In one embodiment, the material may be, for example but is not limited to, cast iron molten metal. Referring to FIG. 4, a vertical casting system 44 is shown according to one embodiment of the invention. In one embodiment, the vertical casting system 44 may include a down sprue 46 for molten metal. The vertical casting system 44 may include a filter 48. The filter 48 may be a ceramic foam filter or block strainer type. The filter 48 may be located in the down sprue 46. The vertical casting system 44 may include at least one gate 50 which may be in the lower half of the mold 15. The at least one gate 50 may be located between the tabs 18 of the insert 10. In one embodiment, the insert comprises at least two tabs 18 and only one gate 50 is positioned in between two adjacent tabs 18. The vertical casting system 44 may be biased to one side of the mold 15 instead of centered on the mold 15. The vertical casting system 44 may minimize turbulent flows of molten metal moving to the insert. The size of each of the at least one gate 50 is dependent on casting configuration and weight. The vertical casting system 44 may also include at least one blind vent 52. In one embodiment, there may be two blind vents 52. In one embodiment, the vertical casting system 44 may include a riser 54 for venting. Referring now to FIG. 5, the vertical casting system 44 is shown with the molten metal entering the at least one gate 50 from the bottom of the mold 15.

Then the mold 15 may continue down the line and cool. The cooling may include exposure to air, or it may include an active means of cooling such as, for example, a fan. The part 500 may then be removed from the mold 15 and allowed to cool further. In one embodiment, the part 500 may then be shot blasted to remove any remaining particles, for example sand, from the mold. In one embodiment, the part 500 may then be inspected for defects. The protruding tabs 18 may be machined off. In one embodiment, the part 500 may be machined further.

Referring to FIGS. 6-20, one embodiment of the invention includes a product or part 500 having a frictional damping means. The frictional damping means may be used in a variety of applications including, but not limited to, applications where it is desirable to reduce noise associated with a vibrating part or reduce the vibration amplitude and/or duration of a part that is struck, dynamically loaded, excited, or set in motion. In one embodiment the frictional damping means may include an interface boundary conducive to frictionally damping a vibrating part. In one embodiment the damping means may include frictional surfaces 502 constructed and arranged to move relative to each other and in frictional contact, so that vibration of the part is dissipated by frictional damping due to the frictional movement of the surfaces 502 against each other.

According to various illustrative embodiments of the invention, frictional damping may be achieved by the movement of the frictional surfaces 502 against each other. The movement of frictional surfaces 502 against each other may include the movement of: surfaces of a body 506 of the part against each other; a surface of the body 506 of the part against a surface of the insert 10; a surface of the body 506 of the part against the layer 520; a surface of the insert 10 against the layer 520; a surface of the body 506 of the part against the particles 514, flakes, or fibers; a surface of the insert 10 against the particles 514, flakes, or fibers; or by frictional movement of the particles 514, flakes, or fibers against each other or against remaining binder material.

In embodiments wherein the frictional surface 502 is provided as a surface of the body 506 or the insert 10 or a layer 520 over one of the same, the frictional surface 502 may have a minimal area over which frictional contact may occur that may extend in a first direction a minimum distance of 0.1 mm and/or may extend in a second (generally traverse) direction a minimum distance of 0.1 mm. In one embodiment the insert 10 may be an annular body and the area of frictional contact on a frictional surface 502 may extend in an annular direction a distance ranging from about 20 mm to about 1000 mm and in a transverse direction ranging from about 10 mm to about 75 mm. The frictional surface 502 may be provided in a variety of embodiments, for example, as illustrated in FIGS. 6-20.

Referring again to FIG. 6, in another embodiment of the invention one or more of outer surfaces 522, 524 of the insert 10 or surfaces 526, 528 of the body 506 of the part 500 may include a relatively rough surface including a plurality of peaks 510 and valleys 512 to enhance the frictional damping of the part. In one embodiment, the surface of the insert 10 or the body 506 may be abraded by sandblasting, glass bead blasting, water jet blasting, chemical etching, machining or the like.

Figure 7:
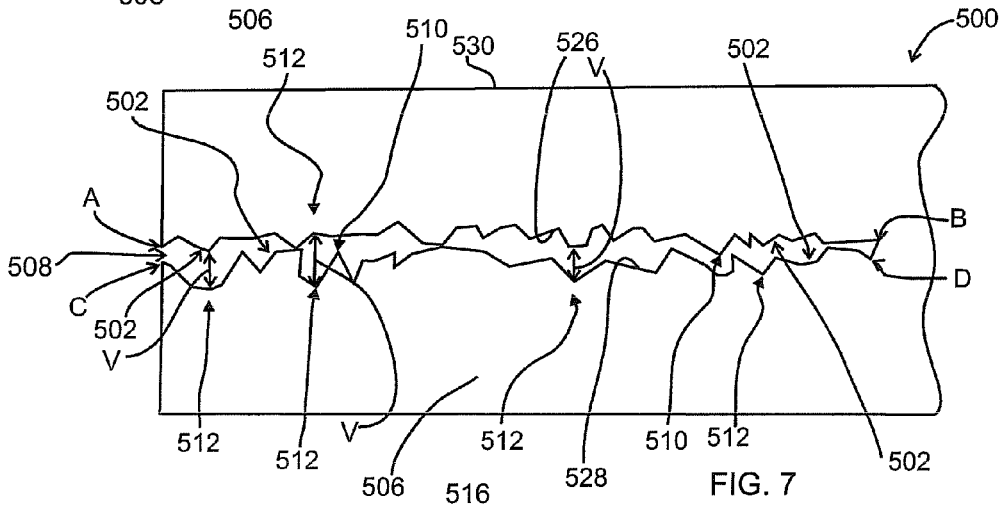
FIG. 7 is a sectional view with portions broken away of one embodiment of the invention including two spaced apart frictional surfaces of a cast metal body portion.

As shown in FIG. 7, in one embodiment one frictional surface 502 (for example extending from points A-B) may be a first surface of the body 506 of the part 500 positioned adjacent to a second frictional surface 502 (for example extending from points C-D) of the body 506. The body 506 may include a relatively narrow slot-like feature 508 formed therein so that at least two of the frictional surfaces 502 defining the slot-like feature 508 may engage each other for frictional movement during vibration of the part to provide frictional damping of the part 500. In various embodiments of the invention, the slot-like feature 508 may be formed by machining the cast part, or by using a sacrificial casting insert that may be removed after the casting by, for example, etching or machining. In one embodiment a sacrificial insert may be used that can withstand the temperature of the molten metal during casting but is more easily machined than the cast metal. Each frictional surface 502 may have a plurality of peaks 510 and a plurality of valleys 512. The depth as indicated by line V of the valleys 512 may vary with embodiments. In various embodiments, the average of the depth V of the valleys 512 may range from about 1 μm-500 μm, 50 μm-260 μm, 100 μm-160 μm or variations of these ranges. However, for all cases there is local contact between the opposing frictional surfaces 502 during component operation for frictional damping to occur.

Figure 9:
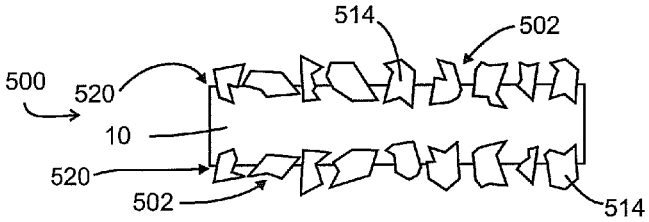
FIG. 9 is an enlarged view of one embodiment of the invention.
Figure 10:
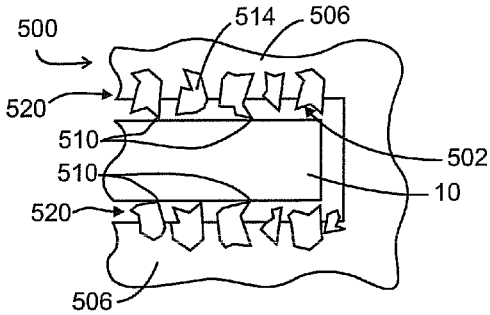
FIG. 10 is a sectional view with portions broken away of one embodiment of the invention.
Figure 11:
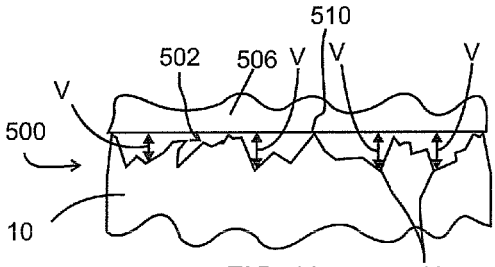
FIG. 11 is an enlarged sectional view with portions broken away of one embodiment of the invention.
Figure 12:
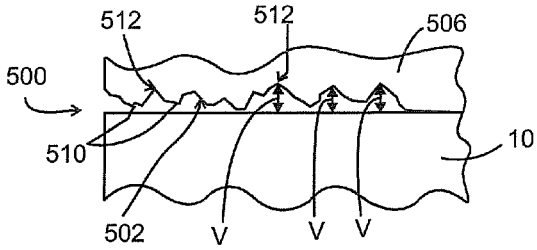
FIG. 12 is an enlarged sectional view with portions broken away of one embodiment of the invention.
Figure 13:
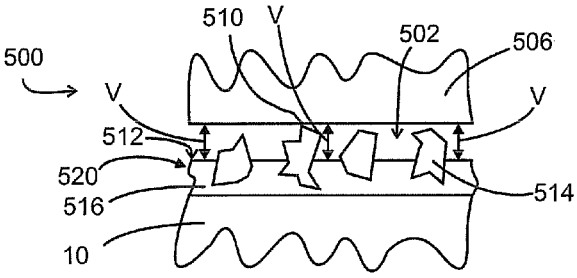
FIG. 13 is an enlarged sectional view with portions broken away of one embodiment of the invention.
Figure 14:
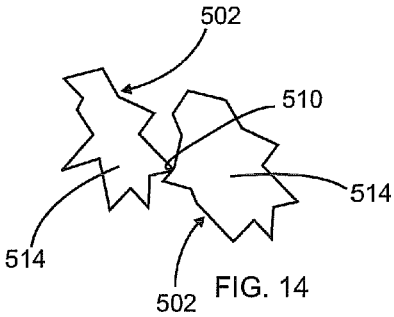
FIG. 14 illustrates one embodiment of the invention.

In another embodiment of the invention the damping means or frictional surface 502 may be provided by particles 514, flakes, or fibers provided on at least one face of the insert 10 or a surface of the body 506 of the part 500. The particles 514, flakes, or fibers may have an irregular shape (e.g., not smooth) to enhance frictional damping, as illustrated in FIG. 14. One embodiment of the invention may include a layer 520 including the particles 514, flakes, or fibers which may be bonded to each other or to a surface of the body 506 of the part or a surface of the insert 10 due to the inherent bonding properties of the particles 514, flakes, or fibers. For example, the bonding properties of the particles 514, flakes, or fibers may be such that the particles 514, flakes, or fibers may bind to each other or to the surfaces of the body 506 or the insert 10 under compression. In another embodiment of the invention, the particles 514, flakes, or fibers may be treated to provide a coating thereon or to provide functional groups attached thereto to bind the particles, flakes, or fibers together or attach the particles, flakes, or fibers to at least one of a surface of the body 506 or a surface of the insert 10. In another embodiment of the invention, the particles 514, flakes, or fibers may be embedded in at least one of the body 506 of the part or the insert 10 to provide the frictional surface 502 (FIGS. 9-10).

In embodiments wherein at least a portion of the part 500 is manufactured such that the insert 10 and/or the particles 514, flakes, or fibers are exposed to the temperature of a molten material such as in casting, the insert 10 and/or particles 514, flakes, or fibers may be made from materials capable of resisting flow or resisting significant erosion during the manufacturing. For example, the insert 10 and/or the particles 514, flakes, or fibers may include refractory materials capable of resisting flow or that do not significantly erode at temperatures above 600° C., above 1300° C., or above 1500° C. When molten material, such as metal, is cast around the insert 10 and/or the particles 514, flakes, or fibers, the insert 10 or the particles 514, flakes, or fibers should not be wet by the molten material so that the molten material does not bond to the insert 10 or layer 520 at locations wherein a frictional surface 502 for providing frictional damping is desired.

Illustrative examples of suitable particles 514, flakes, or fibers include, but are not limited to, particles, flakes, or fibers including silica, alumina, graphite with clay, silicon carbide, silicon nitride, cordierite (magnesium-iron-aluminum silicate), mullite (aluminum silicate), zirconia (zirconium oxide), phyllosilicates, or other high-temperature-resistant particles, flakes, or fibers. In one embodiment of the invention the particles 514, flakes, or fibers may have a length along the longest dimension thereof ranging from about 1 μm-500 μm, or 10 μm-250 μm.

In another embodiment of the invention, the layer 520 may be a coating over the body 506 of the part or the insert 10. The coating may include a plurality of particles 514, flakes, or fibers which may be bonded to each other and/or to the surface of the body 506 of the part or the insert 10 by an inorganic or organic binder 516 (FIGS. 8, 13) or other bonding materials. Illustrative examples of suitable binders include, but are not limited to, epoxy resins, phosphoric acid binding agents, calcium aluminates, sodium silicates, wood flour, or clays. In another embodiment of the invention the particles 514, flakes, or fibers may be held together and/or adhered to the body 506 or the insert 10 by an inorganic binder. In one embodiment, the coating may be deposited on the insert 10 or body 506 as a liquid dispersed mixture of alumina-silicate-based, organically bonded refractory mix.

In another embodiment, the coating may include at least one of alumina or silica particles, mixed with a lignosulfonate binder, cristobalite ($SiO_2$), quartz, or calcium lignosulfonate. The calcium lignosulfonate may serve as a binder. In one embodiment, the coating may include IronKote. In one embodiment, a liquid coating may be deposited on a portion of the insert and may include high temperature Ladle Kote 310B. In another embodiment, the coating may include at least one of clay, $Al_2O_3$, $SiO_2$, a graphite and clay mixture, silicon carbide, silicon nitride, cordierite (magnesium-iron-aluminum silicate), mullite (aluminum silicate), zirconia (zirconium oxide), or phyllosilicates. In one embodiment, the coating may comprise a fiber such as ceramic or mineral fibers.

When the layer 520 including particles 514, flakes, or fibers is provided over the insert 10 or the body 506 of the part the thickness L (FIG. 8) of the layer 520, particles 514, flakes, and/or fibers may vary. In various embodiments, the thickness L of the layer 520, particles 514, flakes, and/or fibers may range from about 1 μm-500 μm, 10 μm-400 μm, 30 μm-300 μm, 30 μm-40 μm, 40 μm-100 μm, 100 μm-120 μm, 120 μm-200 μm, 200 μm-300 μm, 200 μm-250 μm, or variations of these ranges.

In yet another embodiment of the invention the particles 514, flakes, or fibers may be temporarily held together and/or to the surface of the insert 10 by a fully or partially sacrificial coating. The sacrificial coating may be consumed by molten metal or burnt off when metal is cast around or over the insert 10. The particles 514, flakes, or fibers are left behind trapped between the body 506 of the cast part and the insert 10 to provide a layer 520 consisting of the particles 514, flakes, or fibers or consisting essentially of the particles 514, flakes, or fibers.

Figure 8:
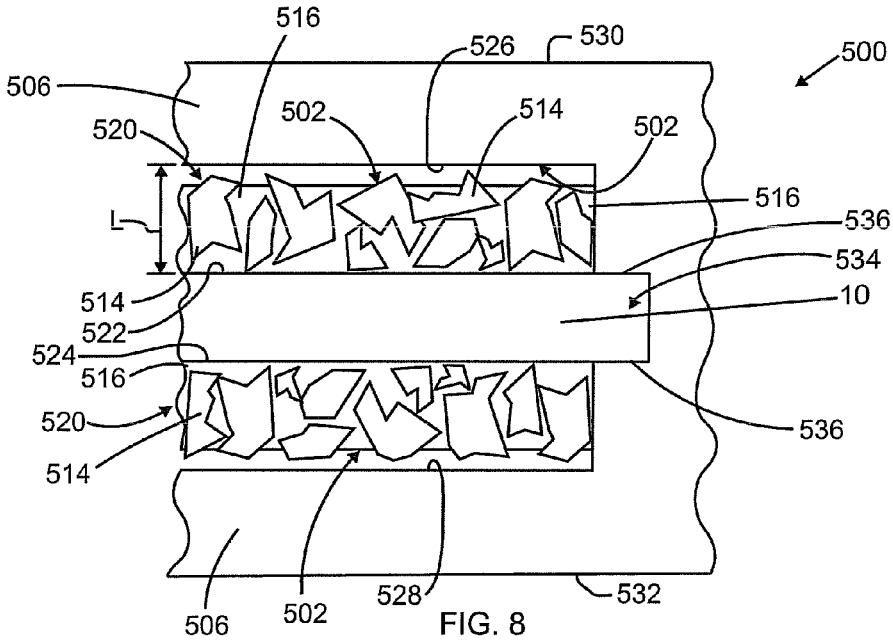
FIG. 8 is a sectional view with portions broken away of one embodiment of the invention including an insert having a layer thereon to provide a frictional surface for damping.

The layer 520 may be provided over the entire insert 10 or only over a portion thereof. In one embodiment of the invention the insert 10 may include a tab 534 (FIG. 8). For example, the insert 10 may include an annular body portion and a tab 534 extending radially inward or outward therefrom. In one embodiment of the invention at least one wettable surface 536 of the tab 534 does not include a layer 520 including particles 514, flakes, or fibers, or a wettable material such as graphite is provided over the tab 534, so that the cast metal is bonded to the wettable surface 536 to attach the insert 10 to the body 506 of the part 500 but still allow for frictional damping over the remaining insert surface which is not bonded to the casting.

In one embodiment of the invention at least a portion of the insert 10 is treated or the properties of the insert 10 are such that molten metal will not wet or bond to that portion of the insert 10 upon solidification of the molten metal. According to one embodiment of the invention at least one of the body 506 of the part or the insert 10 includes a metal, for example, but not limited to, aluminum, steel, stainless steel, cast iron, any of a variety of other alloys, or metal matrix composite including abrasive particles. In one embodiment of the invention the insert 10 may include a material such as a metal having a higher melting point than the melting point of the molten material being cast around a portion thereof.

In one embodiment the insert 10 may have a minimum average thickness of 0.2 mm and/or a minimum width of 0.1 mm and/or a minimum length of 0.1 mm. In another embodiment the insert 10 may have a minimum average thickness of 0.2 mm and/or a minimum width of 2 mm and/or a minimum length of 5 mm. In other embodiments the insert 10 may have a thickness ranging from about 0.1-20 mm, 0.1-6.0 mm, or 1.0-2.5 mm, or ranges therebetween.

Referring now to FIGS. 11-13, again the frictional surface 502 may have a plurality of peaks 510 and a plurality of valleys 512. The depth as indicated by line V of the valleys 512 may vary with embodiments. In various embodiments, the average of the depth V of the valleys 512 may range from about 1 μm-500 μm, 50 μm-260 μm, 100 μm-160 μm or variations of these ranges. However, for all cases there is local contact between the body 506 and the insert 10 during component operation for frictional damping to occur.

In other embodiments of the invention improvements in the frictional damping may be achieved by adjusting the thickness (L, as shown in FIG. 8) of the layer 520, or by adjusting the relative position of opposed frictional surfaces 502 or the average depth of the valleys 512 (for example, as illustrated in FIG. 7).

In one embodiment the insert 10 is not pre-loaded or under pre-tension or held in place by tension. In one embodiment the insert 10 is not a spring. Another embodiment of the invention includes a process of casting a material comprising a metal around an insert 10 with the proviso that the frictional surface 502 portion of the insert used to provide frictional damping is not captured and enclosed by a sand core that is placed in the casting mold. In various embodiments the insert 10 or the layer 520 includes at least one frictional surface 502 or two opposite friction surfaces 502 that are completely enclosed by the body 506 of the part. In another embodiment the layer 520 including the particles 514, flakes, or fibers that may be completely enclosed by the body 506 of the part or completely enclosed by the body 506 and the insert 10, and wherein at least one of the body 506 or the insert 10 comprises a metal or consists essentially of a metal. In one embodiment of the invention the layer 520 and/or insert 10 does not include or is not carbon paper or cloth.

Referring again to FIGS. 6-8, in various embodiments of the invention the insert 10 may include a first face 522 and an opposite second face 524 and the body 506 of the part may include a first inner face 526 adjacent the first face 522 of the insert 10 constructed to be complementary thereto, for example nominally parallel thereto. The body 506 of the part includes a second inner face 528 adjacent to the second face 524 of the insert 10 constructed to be complementary thereto, for example parallel thereto. The body 506 may include a first outer face 530 overlying the first face 522 of the insert 10 constructed to be complementary thereto, for example parallel thereto. The body 506 may include a first outer face 532 overlying the second face 524 of the insert 10 constructed to be complementary thereto, for example parallel thereto. However, in other embodiments of the invention the outer faces 530, 532 of the body 506 are not complementary to associated faces 522, 524 of the insert 10. When the damping means is provided by a narrow slot-like feature 508 formed in the body 506 of the part 500, the slot-like feature 508 may be defined in part by a first inner face 526 and a second inner face 528 which may be constructed to be complementary to each other, for example parallel to each other. In other embodiments the surfaces 526 and 528; 526 and 522; or 528 and 524 are mating surfaces but not parallel to each other.

Referring to FIGS. 15-16, in one embodiment of the invention the insert 10 may be an inlay wherein a first face 522 thereof is not enclosed by the body 506 of the part. The insert 10 may include a tang or tab 534 which may be bent downward as shown in FIG. 15. In one embodiment of the invention a wettable surface 536 may be provided that does not include a layer 520 including particles 514, flakes, or fibers, or a wettable material such as graphite is provided over the tab 534, so that the cast metal is bonded to the wettable surface 536 to attach the insert 10 to the body of the part but still allow for frictional damping on the non-bonded surfaces. A layer 520 including particles 514, flakes, or fibers may underlie the portion of the second face 524 of the insert 10 not used to make the bent tab 534.

In another embodiment the insert 10 includes a tab 534 which may be formed by machining a portion of the first face 522 of the insert 10 (FIG. 16). The tab 534 may include a wettable surface 536 having cast metal bonded thereto to attach the insert 10 to the body of the part but still allow for friction damping by way of the non-bonded surfaces. A layer 520 including particles 514, flakes, or fibers may underlie the entire second face 524 or a portion thereof. In other embodiments of the invention all surfaces including the tabs 534 may be non-wettable, for example by way of a coating 520 thereon, and features of the body portion 506 such as, but not limited to, a shoulder 537 may be used to hold the insert 10 in place.

Figure 17:
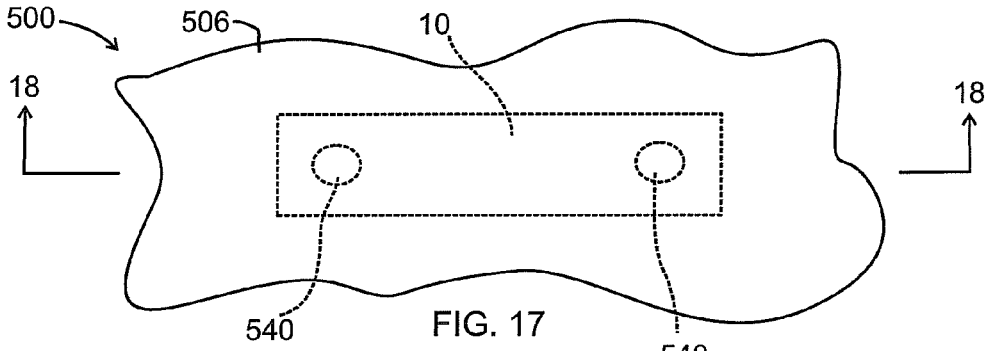
FIG. 17 is a plan view with portions broken away illustrating one embodiment of the invention.

Referring now to FIG. 17, one embodiment of the invention may include a part 500 having a body portion 506 and an insert 10 enclosed by the body part 506. The insert 10 may include through holes formed therein so that a stake or post 540 extends into or through the insert 10.

Figure 18:
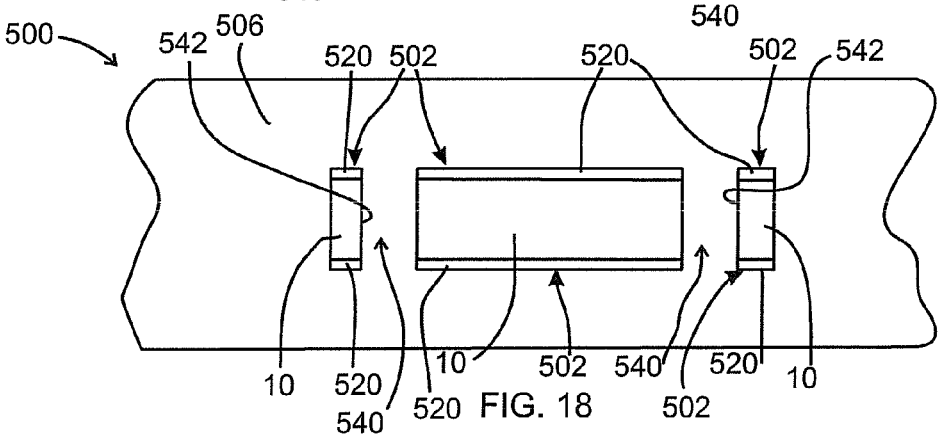
FIG. 18 is a sectional view taken along line 18-18 of FIG. 17 illustrating one embodiment of the invention.

Referring to FIG. 18, which is a sectional view of FIG. 17 taken along line 18-18, in one embodiment of the invention a layer 520 including a plurality of particles 514, flakes, or fibers (not shown) may be provided over at least a portion of the insert 10 to provide a frictional surface 502 and to prevent bonding thereto by cast metal. The insert 10 including the layer 520 may be placed in a casting mold and molten metal may be poured into the casting mold and solidified to form the post 540 extending through the insert 10. An inner surface 542 defining the through hole of the insert 10 may be free of the layer 520 or may include a wettable material thereon so that the post 540 is bonded to the insert 10. Alternatively, in another embodiment the post 504 may not be bonded the insert 10 at the inner surface 542. The insert 10 may include a feature such as, but not limited to, a shoulder 505 and/or the post 540 may include a feature such as, but not limited to, a shoulder 537 to hold the insert in place.

Figure 19:
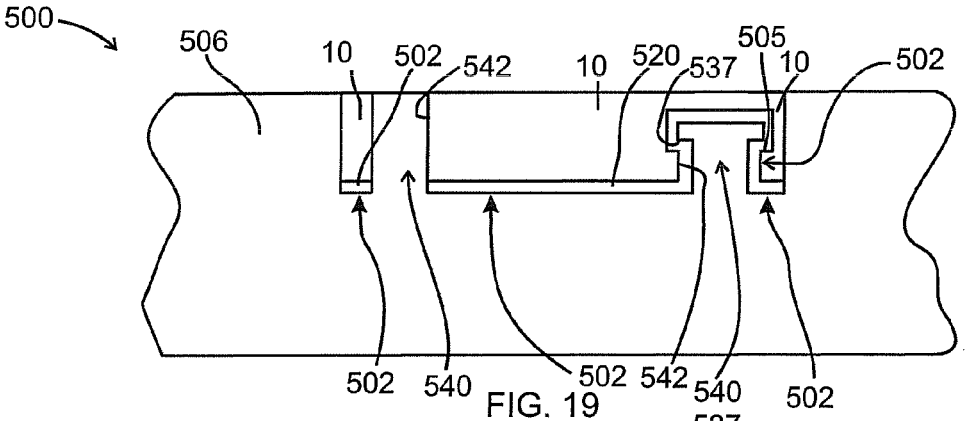
FIG. 19 is a sectional view with portions broken away illustrating one embodiment of the invention.

Referring now to FIG. 19, in another embodiment, the insert may be provided as an inlay in a casting including a body portion 506 and may include a post 540 extending into or through the insert 10. The insert 10 may be bonded to the post 540 to hold the insert in place and still allow for frictional damping. In one embodiment of the invention the insert 10 may include a recess defined by an inner surface 542 of the insert 10 and a post 540 may extend into the insert 10 but not extend through the insert 10. In one embodiment the post 504 may not be bonded to the insert 10 at the inner surface 542. The insert 10 may include a feature such as, but not limited to, a shoulder 505 and/or the post 540 may include a feature such as, but not limited to, a shoulder 537 to hold the insert in place.

Figure 20:
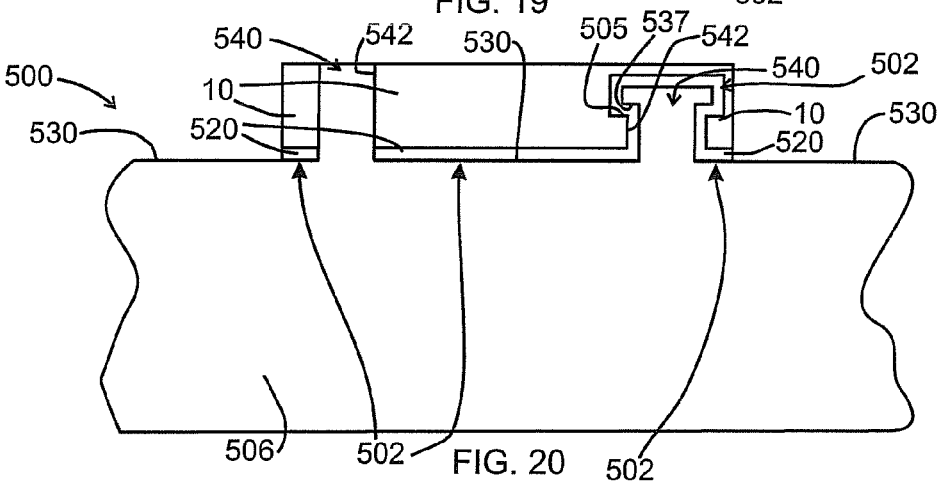
FIG. 20 is a sectional view, with portions broken away illustrating another embodiment of the invention.

Referring now to FIG. 20, in another embodiment of the invention, an insert 10 or substrate may be provided over an outer surface 530 of the body portion 506. A layer 520 may or may not be provided between the insert 10 and the outer surface 530. The insert 10 may be constructed and arranged with through holes formed therethrough or a recess therein so that cast metal may extend into or through the insert 10 to form a post 540 to hold the insert in position and still allow for frictional damping. The post 540 may or may not be bonded to the insert 10 as desired. The post 540 may extend through the insert 10 and join another portion of the body 506 if desired.

When the term "over," "overlying," overlies," "under," "underlying," or "underlies" is used herein to describe the relative position of a first layer or component with respect to a second layer or component such shall mean the first layer or component is directly on and in direct contact with the second layer or component or that additional layers or components may be interposed between the first layer or component and the second layer or component.

The above description of embodiments of the invention is merely exemplary in nature and, thus, variations thereof are not to be regarded as a departure from the spirit and scope of the invention.

What is claimed is:

1. A method comprising:

treating a first portion of the insert so that molten material comprising a metal does not wet the first portion of the insert and bond thereto upon solidification, and a second portion of the insert being constructed and arranged so that metal cast over the second portion bonds to the second portion upon cooling; and pre-heating an insert to a temperature ranging from 50-80° C. to remove moisture on the insert and thereafter loading the insert into a first mold portion of a vertical mold for casting metal, and casting metal over the insert and solidifying the metal so that the metal bonds to the second portion and not to the first portion wherein the insert comprises a bent tab so that the insert hangs on the first mold portion of the vertical mold.

2. A method as set forth in claim 1 wherein the pre-heating the insert comprises heating the insert in an oven.

3. A method as set forth in claim 1 wherein the temperature is about 75° C.

4. A method as set forth in claim 1 further comprising closing a second mold portion and the first mold portion together and casting a material comprising a metal around at least a portion of the insert.

5. A method as set forth in claim 1 further comprising pre-treating the second portion of the insert before positioning the insert in the vertical mold.

6. A method as set forth in claim 5 wherein the pre-treating comprises at least one of sand blasting, grit blasting, glass bead blasting, chemical washing, or water jet degreasing.

7. A method as set forth in claim 1 wherein the treating comprises coating at least a portion of the insert to provide a non-wettable surface that prevented molten metal from bonding to the insert at the location of the coating.

8. A method as set forth in claim 7 wherein coating at least a portion of the insert comprises at least one of spraying, dipping, or painting.

9. A method as set forth in claim 7 further comprising baking the insert.

10. A method as set forth in claim 7 further comprising pouring the material into the vertical mold so that the metal is filled from the bottom of the mold up.

11. A method as set forth in claim 1 further comprising pouring the material into at least one gate located at the bottom of the vertical mold.

12. A method as set forth in claim 11 wherein the insert comprises at least two tabs and wherein only one gate is positioned in between two adjacent tabs.

13. A method as set forth in claim 10 wherein the flow rate of the material poured into the vertical mold is such that turbulent flow is avoided.

14. A method as set forth in claim 4 further comprising controlling the flow of the molten metal into the first and second mold portions to prevent the casting of the material comprising molten metal around the insert from washing away the coating.

15. A method as set forth in claim 1 wherein the coating comprising at least one of particles, flakes, or fibers.

16. A method as set forth in claim 1 wherein the loading the insert into a first mold portion comprises loading an insert into a setting fixture.

17. A method as set forth in claim 16 wherein the setting fixture comprises a vacuum component.

18. A method as set forth in claim 16 wherein the setting fixture comprises at least one ejector pin.

19. A method as set forth in claim 1 wherein the insert is pre-heated to a temperature ranging from 50-75° C.

20. A method as set forth in claim 7 further comprising baking the insert with the coating to a temperature of 140-350° C.

* * * * *